US007847484B2

(12) United States Patent
Smith et al.

(10) Patent No.: US 7,847,484 B2
(45) Date of Patent: Dec. 7, 2010

(54) MERCURY-FREE AND SODIUM-FREE COMPOSITIONS AND RADIATION SOURCE INCORPORATING SAME

(75) Inventors: David John Smith, Clifton Park, NY (US); Timothy John Sommerer, Ballston Spa, NY (US); Joseph Darryl Michael, Schoharie, NY (US); Vikas Midha, Clifton Park, NY (US); George Michael Cotzas, Saratoga Springs, NY (US)

(73) Assignee: General Electric Company, Niskayuna, NY (US)

( * ) Notice: Subject to any disclaimer, the term of this patent is extended or adjusted under 35 U.S.C. 154(b) by 1033 days.

(21) Appl. No.: 11/015,636

(22) Filed: Dec. 20, 2004

(65) Prior Publication Data

US 2006/0132042 A1 Jun. 22, 2006

(51) Int. Cl.
*H01J 61/18* (2006.01)
*H01J 61/12* (2006.01)

(52) U.S. Cl. ..... 313/638; 313/637

(58) Field of Classification Search ..... None
See application file for complete search history.

(56) References Cited

U.S. PATENT DOCUMENTS

| | | | |
|---|---|---|---|
| 2,765,416 A | 10/1956 | Beese et al. | |
| 3,764,843 A | 10/1973 | Van Eijil et al. | |
| 4,001,626 A | 1/1977 | Drop et al. | |
| 4,157,485 A | 6/1979 | Wesselink et al. | |
| 4,360,756 A | 11/1982 | Spencer et al. | |
| 4,387,319 A | 6/1983 | White et al. | |
| 4,439,711 A | 3/1984 | Murakami et al. | |
| 4,924,142 A | 5/1990 | Kaldenhoven | |
| 5,192,891 A | 3/1993 | Matsuura et al. | |
| 5,481,159 A | 1/1996 | Hiramoto et al. | |
| 5,798,612 A | 8/1998 | Dirks | |
| 6,069,456 A * | 5/2000 | Fromm et al. | 315/248 |
| 6,137,230 A | 10/2000 | Born et al. | |
| 6,218,781 B1 | 4/2001 | Genz et al. | |
| 6,380,675 B1 | 4/2002 | Genz et al. | |
| 6,538,378 B1 | 3/2003 | Nakano | |
| 6,603,267 B2 | 8/2003 | Hilbig et al. | |
| 6,734,630 B1 | 5/2004 | Choi et al. | |
| 6,756,721 B2 | 6/2004 | Higashi et al. | |
| 2002/0047525 A1 | 4/2002 | Scholl et al. | |
| 2003/0001505 A1 | 1/2003 | Scholl et al. | |
| 2003/0178942 A1 | 9/2003 | Born et al. | |

(Continued)

FOREIGN PATENT DOCUMENTS

EP 0225753 A2 * 6/1987

(Continued)

OTHER PUBLICATIONS

PCT Search Report—Feb. 23, 2007.

*Primary Examiner*—Toan Ton
*Assistant Examiner*—Britt D Hanley
(74) *Attorney, Agent, or Firm*—Mary Louise Gioeni

(57) ABSTRACT

An ionizable mercury-free and sodium-free composition is capable of emitting radiation if excited. A radiation source includes such an ionizable mercury-free and sodium-free composition. The ionizable mercury-free and sodium-free composition includes at least a metal, a metal and a metal compound, or a metal compound.

20 Claims, 5 Drawing Sheets

U.S. PATENT DOCUMENTS

| | | | |
|---|---|---|---|
| 2003/0184231 | A1 | 10/2003 | Eisemann |
| 2003/0209987 | A1 | 11/2003 | Kakisaka et al. |
| 2003/0214234 | A1 | 11/2003 | Fukushima |

FOREIGN PATENT DOCUMENTS

| | | | | |
|---|---|---|---|---|
| EP | 0407160 | A2 | | 1/1991 |
| GB | 1502612 | | | 3/1978 |
| JP | 11-102663 | | * | 4/1999 |
| RU | 2027248 | | | 1/1995 |
| WO | 2004/025688 | A2 | | 3/2004 |
| WO | 2004/049387 | A2 | | 6/2004 |

* cited by examiner

MERCURY-FREE AND SODIUM-FREE COMPOSITIONS AND RADIATION SOURCE INCORPORATING SAME

BACKGROUND

The present invention relates generally to a mercury-free and sodium-free composition capable of emitting radiation if excited. In particular, the invention relates to a radiation source comprising an ionizable mercury-free and sodium free composition being capable of emitting radiation if excited.

Ionizable compositions are used in discharge sources. In a discharge radiation source, radiation is produced by an electric discharge in a medium. The discharge medium is usually in the gas or vapor phase and is preferably contained in a housing capable of transmitting the radiation generated out of the housing. The discharge medium is usually ionized by applying an electric field created by applying a voltage across a pair of electrodes placed across the medium. Radiation generation occurs in gaseous discharges when energetic charged particles, such as electrons and ions, collide with gas atoms or molecules in the discharge medium, causing atoms and molecules to be ionized or excited. A significant part of the excitation energy is converted to radiation when these atoms and molecules relax to a lower energy state, and in the process emit the radiation.

Gas discharge radiation sources are available and operate in a range of internal pressures. At one end of the pressure range, the chemical species responsible for the emission is present in very small quantities, generating a pressure during operation of a few hundreds pascals or less. The radiating chemical species may sometimes constitute as little as 0.1% of the total pressure.

Gas discharge radiation sources having a total operating pressure at the low end of the pressure range and radiating at least partly in the UV spectrum range, that include coatings of phosphors, can convert UV radiation to visible radiation, and are often referred to as fluorescent sources. Phosphors also help determine the color properties of fluorescent sources. A mixture of phosphors is usually used to produce a desired color appearance.

Other gas discharge sources, including high intensity discharge sources, operate at relatively higher pressures (from about 0.05 MPa to about 20 MPa) and relatively high temperatures (higher than about 600° C.). These discharge sources usually contain an inner arc tube enclosed within an outer envelope.

Many commonly used discharge radiation sources contain mercury as a component of the ionizable composition. Disposal of such mercury-containing radiation sources is potentially harmful to the environment. Therefore, it is desirable to provide mercury-free discharge compositions capable of emitting radiation, which can be used in radiation sources.

SUMMARY OF INVENTION

In general, the present invention provides ionizable mercury-free and sodium-free compositions that are capable of emitting radiation when excited and radiation sources that incorporate one of such compositions.

In one aspect of the present invention, the ionizable mercury-free and sodium-free composition comprises an inert buffer gas and at least a first metal selected from the group consisting of Mn, Ni, Cu, Al, Ga, In, Tl, Ge, Sn, Pb, Bi, Ti, V, Cr, Zr, Nb, Mo, Hf, Ta, W, Re, Os, and combinations thereof. The composition excluding the inert buffer gas produces a total vapor pressure less than about $1\times10^3$ Pa if excited.

In another aspect of the present invention, the ionizable mercury-free and sodium-free composition comprises an inert buffer gas and at least a first metal selected from the group consisting of Mn, Ni, Cu, Al, Ga, In, Tl, Ge, Sn, Pb, Bi, Ti, V, Cr, Zr, Nb, Mo, Hf, Ta, W, Re, Os, and combinations thereof with the proviso that In, Bi, Pb, and Ga are absent when a tin halide is present.

In still another aspect of the present invention, an ionizable mercury-free and sodium-free composition comprises an inert buffer gas and at least a first metal selected from the group consisting of Mn, Ni, Cu, Al, Ga, In, Ti, Ge, Sn, Pb, Bi, Ti, V, Cr, Zr, Nb, Mo, Hf, Ta, W, Re, Os, and combinations thereof, and at least a compound of a second metal selected from the group consisting of Mn, Ni, Cu, Al, Ga, In, Ti, Ge, Sn, Pb, Bi, Ti, V, Cr, Zr, Nb, Mo, Hf, Ta, W, Re, Os, and combinations thereof with the proviso that Ge is absent when Se is present and the proviso that In, Bi, Pb and Ga and halides thereof are absent when a tin halide is present. The metal compound is selected from the group consisting of halides, oxides, chalcogenides, hydroxide, hydride, organometallic compounds and combinations thereof.

In another aspect, an ionizable mercury-free and sodium-free composition comprises an inert buffer gas and at least a compound of a metal selected from the group consisting of Mn, Ni, Al, Ga, Tl, Ge, Sn, Pb, Bi, Ti, V, Cr, Zr, Nb, Mo, Hf, Ta, W, Re, Os, and combinations thereof. The metal compound is selected from the group consisting of halides, oxides, chalcogenides, hydroxide, hydride, organometallic compounds, and combinations thereof.

In another aspect, the present invention provides a radiation source that includes an ionizable mercury-free and sodium-free composition that comprises at least a first metal selected from the group consisting of Mn, Ni, Cu, Al, Ga, In, Tl, Ge, Sn, Pb, Bi, Ti, V, Cr, Zr, Nb, Mo, Hf, Ta, W, Re, Os, and combinations thereof. The vapor pressure of the metal in the radiation source during its operation is less than about $1\times10^3$ Pa.

In a further aspect, the present invention provides a radiation source that includes an ionizable mercury-free and sodium-free composition that comprises at least a first metal selected from the group consisting of Mn, Ni, Cu, Al, Ga, In, Tl, Ge, Sn, Pb, Bi, Ti, V, Cr, Zr, Nb, Mo, Hf, Ta, W, Re, Os, and combinations thereof with the proviso that In, Bi, Pb, and Ga are absent when a tin halide is present.

In still another aspect of the present invention, a radiation source includes an ionizable mercury-free composition and sodium-free composition that comprises at least a first metal selected from the group consisting of Mn, Ni, Cu, Al, Ga, In, Tl, Ge, Sn, Pb, Bi, Ti, V, Cr, Zr, Nb, Mo, Hf, Ta, W, Re, Os, and combinations thereof, and at least a compound of a second metal selected from the group consisting of Mn, Ni, Cu, Al, Ga, In, Tl, Ge, Sn, Pb, Bi, Ti, V, Cr, Zr, Nb, Mo, Hf, Ta, W, Re, Os, and combinations thereof with the proviso that Ge is absent when Se is present and the proviso that In, Bi, Pb and Ga and halides thereof are absent when a tin halide is present The metal compound is selected from the group consisting of halides, oxide, chalcogenides, hydroxide, hydride, organometallic compounds and combinations thereof.

In still another aspect of the present invention, a radiation source includes an ionizable mercury-free and sodium-free composition comprises at least a compound of a metal selected from the group consisting of Mn, Ni, Al, Ga, Ti, Ge, Sn, Pb, Bi, Ti, V, Cr, Zr, Nb, Mo, Hf, Ta, W, Re, Os, and combinations thereof. The metal compound is selected from the group consisting of halides, oxides, chalcogenides, hydroxide, hydride, organometallic compounds, and combinations thereof.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
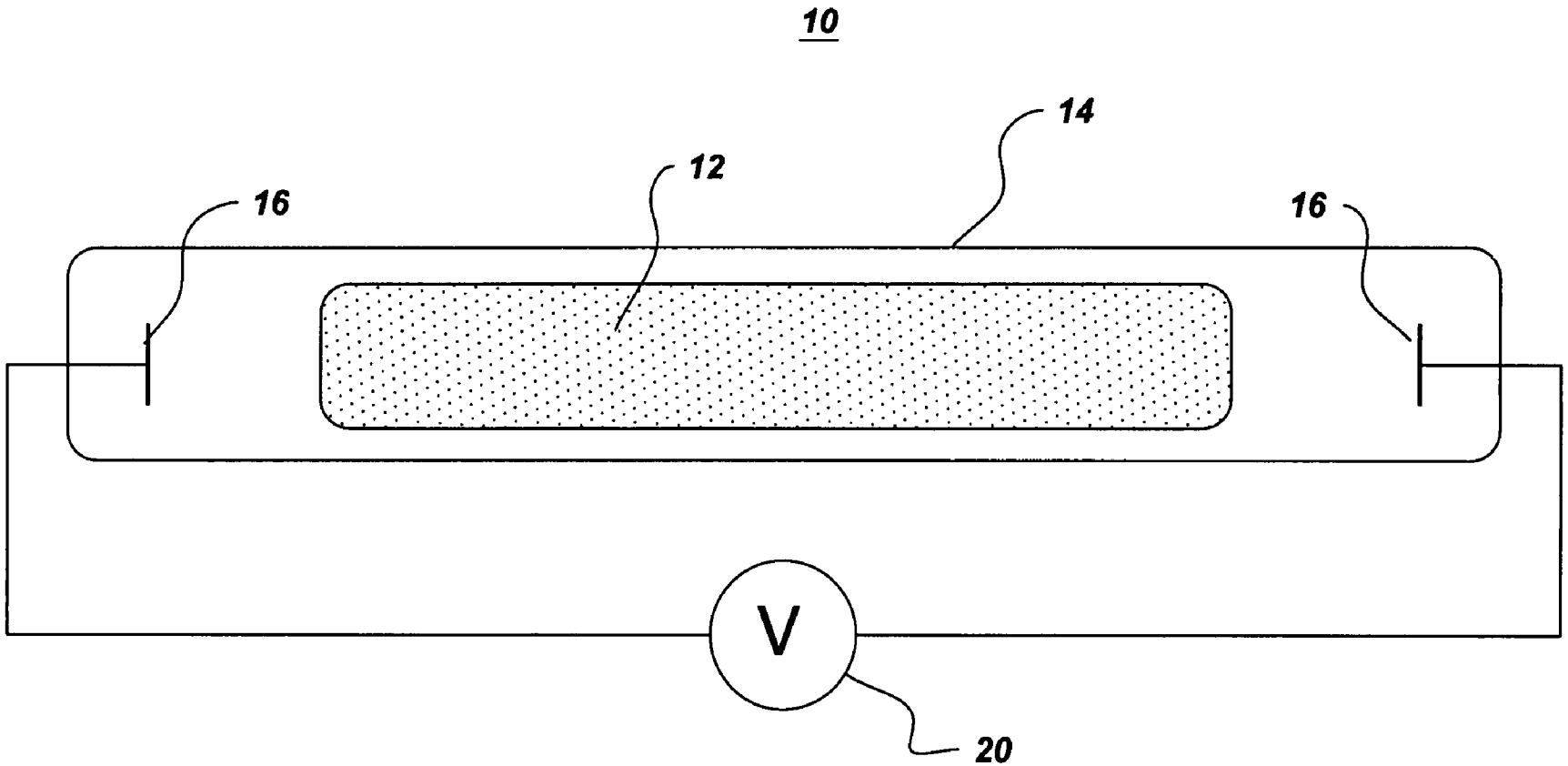
FIG. 1 is a radiation source in one embodiment of the present invention.

In one embodiment of the present invention, an ionizable mercury-free composition of the present invention that comprises an inert buffer gas and at least a first metal selected from the group consisting of Mn, Ni, Cu, Al, Ga, In, Tl, Ge, Sn, Pb, Bi, Ti, V, Cr, Zr, Nb, Mo, Hf, Ta, W, Re, Os, and combinations thereof, in an amount such that a vapor pressure of the metal during an operation of a radiation source comprising such a composition is less than about $1\times10^3$ Pa. The vapor pressure of the metal during operation is preferably less than about 100 Pa and, more preferably, less than about 10 Pa. The metal is preferably selected from the group consisting of Ga, Mn, and combinations thereof, more preferably the metal is Ga.

In a further embodiment, the ionizable mercury-free and sodium-free composition further comprises at least a compound of at least a second metal selected from the group consisting of Mn, Ni, Cu, Al, Ga, In, Tl, Ge, Sn, Pb, Bi, Ti, V, Cr, Zr, Nb, Mo, Hf, Ta, W, Re, Os, and combinations thereof. The compound is selected from the group consisting of halides, oxides, chalcogenides, hydroxide, hydride, organometallic compounds and combinations thereof. The ionizable composition excluding the inert buffer gas producing a total vapor pressure less than about $1\times10^3$ Pa if excited, preferably less than about 100 Pa and, more preferably, less than about 10 Pa. The second metal is preferably selected from the group consisting of Ga, Mn, and combinations thereof, more preferably the first and second metals are Ga. In one embodiment, the first and the second metals are the same. In another embodiment, the first metal and the second metal are different. In a further embodiment the metal compound is a halide. In one embodiment the halide is an iodide. In another embodiment the halide is a bromide.

In a second embodiment of the present invention, an ionizable mercury-free and sodium-free composition comprises an inert buffer gas and at least a metal selected from the group consisting of Mn, Ni, Cu, Al, Ga, In, Tl, Ge, Sn, Pb, Bi, Ti, V, Cr, Zr, Nb, Mo, Hf, Ta, W, Re, Os, and combinations thereof, with the proviso that In, Bi, Pb, and Ga are absent when a tin halide is present. The metal is preferably selected from the group consisting of Ga, Mn, and combinations thereof, more preferably the metal is Ga.

In a further embodiment the ionizable mercury-free and sodium-free composition, further comprises at least a compound of said at least a second metal selected from the group consisting of Mn, Ni, Cu, Al, Ga, In, Tl, Ge, Sn, Pb, Bi, Ti, V, Cr, Zr, Nb, Mo, Hf, Ta, W, Re, and Os. The compound is selected from the group consisting of halides, oxides, chalcogenides, hydroxide, hydride, organometallic compounds and combinations thereof. In another embodiment the metal compound is a halide. In one embodiment the halide is an iodide. In another embodiment the halide is a bromide.

In a third embodiment of the present invention, an ionizable mercury-free and sodium-free composition comprises an inert buffer gas and at least a first metal selected from the group consisting of Mn, Ni, Cu, Al, Ga, In, Tl, Ge, Sn, Pb, Bi, Ti, V, Cr, Zr, Nb, Mo, Hf, Ta, W, Re, Os, and combinations thereof, and at least a compound of a second metal selected from the group consisting of Mn, Ni, Cu, Al, Ga, In, Tl, Ge, Sn, Pb, Bi, Ti, V, Cr, Zr, Nb, Mo, Hf, Ta, W, Re, Os, and combinations thereof, with the proviso that Ge is absent when Se is present; and the proviso that In, Bi, Pb and Ga and halides thereof are absent when a tin halide is present. The metal compound is selected from the group consisting of halides, oxides, chalcogenides, hydroxide, hydride, organometallic compounds with the proviso that Ge is absent when Se is present, and combinations thereof. In one embodiment, the first and the second metals are the same. In another embodiment, the first metal and the second metal are different. In a further embodiment the metal compound is a halide. In one embodiment the halide is an iodide. In another embodiment the halide is a bromide.

In a fourth embodiment of the present invention, an ionizable mercury-free and sodium-free composition comprises an inert buffer gas and at least a compound of a metal selected from the group consisting of Mn, Ni, Al, Ga, Tl, Ge, Sn, Pb, Bi, Ti, V, Cr, Zr, Nb, Mo, Hf, Ta, W, Re, Os, and combinations thereof. The metal compound is selected from the group consisting of halides, oxides, chalcogenides, hydroxide, hydride, organometallic compounds and combinations thereof. In one embodiment, the metal compound is gallium iodide. In another embodiment the metal compound is bismuth iodide.

In another embodiment of the present invention, a radiation source comprises an ionizable mercury-free and sodium-free composition that comprises at least a metal selected from the group consisting of Mn, Ni, Al, Ga, TI, Ge, Sn, Pb, Bi, Ti, V, Cr, Zr, Nb, Mo, Hf, Ta, W, Re, Os and combinations thereof. The metal being present in an amount such that a vapor pressure of said least a metal during an operation of the radiation source is less than about $1\times10^3$ Pa, preferably, less than about 100 Pa, and more preferably, less than about 10 Pa.

In a further embodiment of the present invention, the ionizable mercury-free and sodium-free composition of the radiation source further comprises at least a compound of at least a second metal selected from the group consisting of Mn, Ni, Cu, Al, Ga, In, Tl, Ge, Sn, Pb, Bi, Ti, V, Cr, Zr, Nb, Mo, Hf, Ta, W, Re, Os, and combinations thereof. The compound is selected from the group consisting of halides, oxides, chalcogenides, hydroxide, hydride, organometallic compounds and combinations thereof. The ionizable composition excluding the inert buffer gas producing a total vapor pressure less than about $1\times10^3$ Pa if excited, preferably less than about 100 Pa and, more preferably, less than about 10 Pa. The second metal is preferably selected from the group consisting of Ga, Mn, and combinations thereof, more preferably the first and second metals are Ga. In one embodiment, the first and the second metals are the same. In another embodiment, the first metal and the second metal are different. In a further embodiment the metal compound is a halide. In one embodiment the halide is an iodide. In another embodiment the halide is a bromide.

In a further embodiment of the present invention, a radiation source comprises an ionizable mercury-free and sodium-free composition that comprises a metal selected from the group consisting of at least a metal selected from the group consisting of Mn, Ni, Al, Ga, Tl, Ge, Sn, Pb, Bi, Ti, V, Cr, Zr, Nb, Mo, Hf, Ta, W, Re, Os, and combinations thereof with the proviso that In, Bi, Pb, and Ga are absent when a tin halide is present.

In a further embodiment of the present invention, the ionizable mercury-free and sodium-free composition of the radiation source, further comprises at least a compound of said at least a second metal selected from the group consisting of Mn, Ni, Cu, Al, Ga, In, Tl, Ge, Sn, Pb, Bi, Ti, V, Cr, Zr, Nb, Mo, Hf, Ta, W, Re, and Os.

The compound is selected from the group consisting of halides, oxides, chalcogenides, hydroxide, hydride, organometallic compounds and combinations thereof. In another embodiment, the metal compound is a halide. In one embodiment the halide is an iodide. In another embodiment the halide is a bromide.

In still another embodiment of the present invention, a radiation source comprises an ionizable mercury-free and sodium-free composition that comprises at least a first metal selected from the group consisting of Mn, Ni, Al, Ga, Tl, Ge, Sn, Pb, Bi, Ti, V, Cr, Zr, Nb, Mo, Hf, Ta, W, Re, Os, and combinations thereof and at least a compound of a second metal selected from the group consisting of Mn, Ni, Al, Ga, Tl, Ge, Sn, Pb, Bi, Ti, V, Cr, Zr, Nb, Mo, Hf, Ta, W, Re, Os, and combinations thereof with the proviso that Ge is absent when Se is present and the proviso that In, Bi, Pb, and Ga are absent when a tin halide is present. The metal compound is selected from the group consisting of halides, oxide, chalcogenides, hydroxide, hydride, organometallic compounds; and combinations thereof. The first metal is preferably selected from the group consisting of Ga, Mn, and combinations thereof. In one embodiment, the first and the second metals are the same. In another embodiment, the first metal and the second metal are different. Preferably, the first and second metals are Ga. In one preferred embodiment, the first metal is Ga, and the compound of the second metal is gallium halide. In another preferred embodiment, the gallium halide is gallium iodide. In another embodiment the halide is a bromide.

In a further embodiment of the present invention, a radiation source comprises an ionizable mercury-free and sodium-free composition that comprises an inert buffer gas and at least a compound of a metal selected from the group consisting of Mn, Ni, Al, Ga, TI, Ge, Sn, Pb, Bi, Ti, V, Cr, Zr, Nb, Mo, Hf, Ta, W, Re, Os, and combinations thereof. The metal compound is selected from the group consisting of halides, oxides, chalcogenides, hydroxide, hydride, organometallic compounds, and combinations thereof. In one embodiment the metal compound is gallium iodide. In another embodiment the metal compound is bismuth iodide. In another embodiment, the radiation source comprises an ionizable mercury-free and sodium-free composition that consists of an inert buffer gas and a compound of one metal selected from the group consisting of Mn, Ni, Al, Ga, Ti, Ge, Sn, Pb, Bi, Ti, V, Cr, Zr, Nb, Mo, Hf, Ta, W, Re, and Os. In still another embodiment, the metal compound is a gallium halide, preferably gallium iodide. In yet another embodiment, the metal compound is a bismuth halide, preferably bismuth iodide.

In one embodiment, the metal is present as elemental metal in an unexcited state. In another embodiment, the metal is present as a component of an alloy with at least another metal other than mercury or sodium.

In one aspect of the present invention, the metal compound of the ionizable composition of the radiation source is a metal halide. In a further aspect, the metal halide is a metal iodide. In another aspect, the metal halide is metal bromide. In one embodiment, the ionizable composition comprises at least two metal compounds.

In a further aspect of the present invention, the metal compound in the ionizable composition of the radiation source is gallium halide. In another aspect, the gallium halide is gallium iodide. In still another aspect, the gallium halide is gallium bromide.

The inert buffer gas comprises an inert gas selected from the group consisting of helium, neon, argon, krypton, xenon, and combinations thereof. The inert buffer gas enables the gas discharge to be more readily ignited. The inert buffer gas also controls the steady state operation, and can be used to optimize an operation of the radiation source. In a non-limiting example, argon is used as the inert buffer gas. Argon may be substituted, either completely or partly, with another inert gas, such as helium, neon, krypton, xenon, or combinations thereof.

In one aspect of the invention, the gas pressure of the inert gas at the operating temperature is in the range from about 1 Pascal to about $1\times10^4$ Pa, preferably from about 100 Pa to about $1\times10^3$ Pa.

Within the scope of this invention, the efficiency of the radiation source may be improved by including two or more gallium compounds in the ionizable composition. The efficiency may be further improved by optimizing the internal pressure of the discharge during operation. Such optimization can be effected by controlling the partial pressure of the metal and/or metal compounds, or by controlling the pressure of the inert buffer gas, or by controlling the partial pressure of the metal and/or metal compounds and the pressure of the inert buffer gas. Moreover, the applicants have discovered that an increase in the luminous efficacy can be achieved by controlling the operating temperature of the discharge. The luminous efficacy, expressed in lumen/Watt, is the ratio between the brightness of the radiation in a specific visible wavelength range and the energy for generating the radiation.

FIG. 1 schematically illustrates a gas discharge radiation source 10. FIG. 1 shows a tubular housing or vessel 14 containing an ionizable composition of the present invention. The material comprising the housing 14 may be transparent or opaque. The housing 14 may have a circular or non-circular cross section, and need not be straight. In one embodiment, the discharge 12 is desirably excited by thermionically emitting electrodes 16 connected to a voltage source 20. The discharge may also be generated by other methods of excitation that provide energy to the composition. It is within the scope of this invention that various waveforms of voltage and current, including alternating or direct, are contemplated for the present invention. It is also within the scope of this invention that additional voltage sources may also be present to help maintain the electrodes at a temperature sufficient for thermionic emission of electrons.

Figure 2:
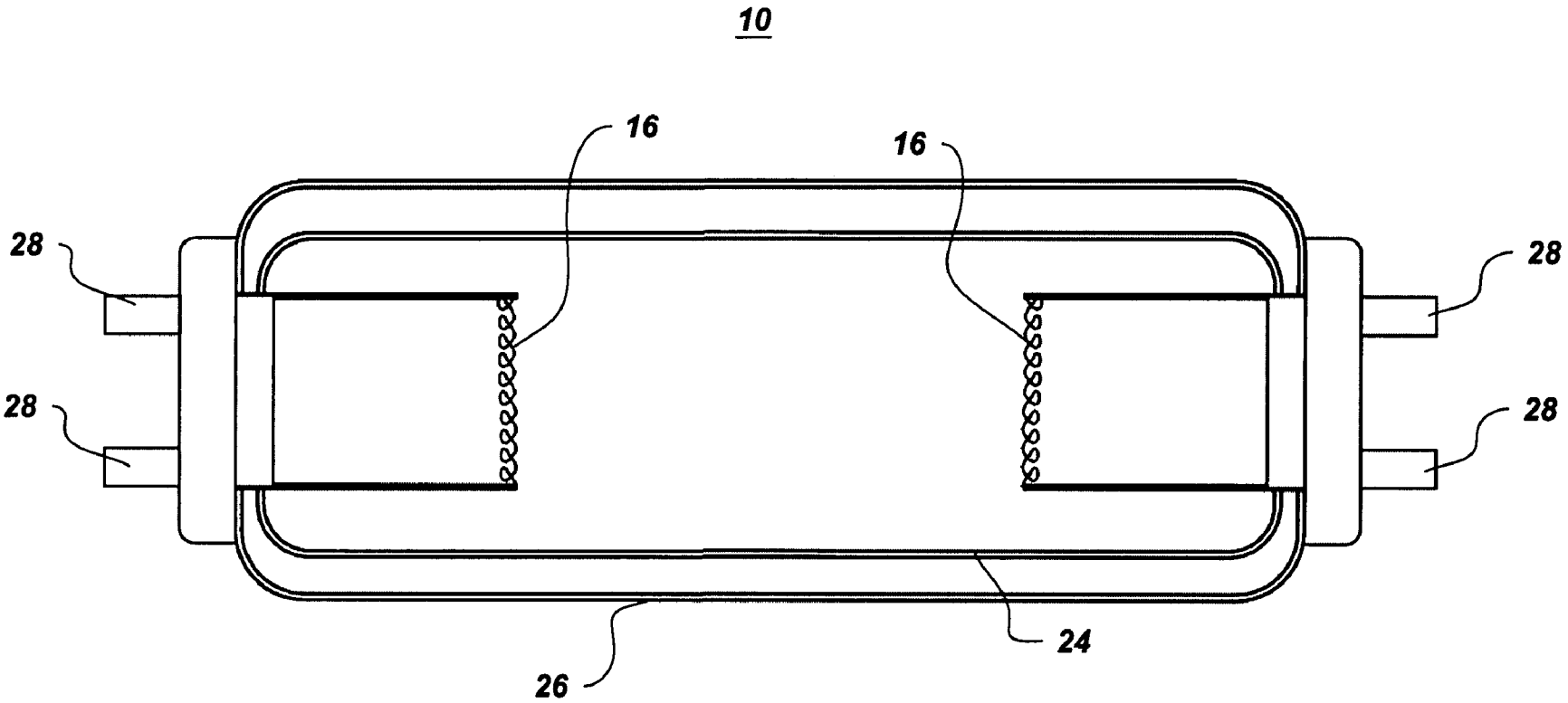
FIG. 2 is a radiation source in a second embodiment of the present invention.

FIG. 2 schematically illustrates another embodiment of a gas discharge radiation source 10. The housing comprises an inner envelope 24 and an outer envelope 26. The space between the two envelopes is either evacuated or filled with a gas.

Figure 3:
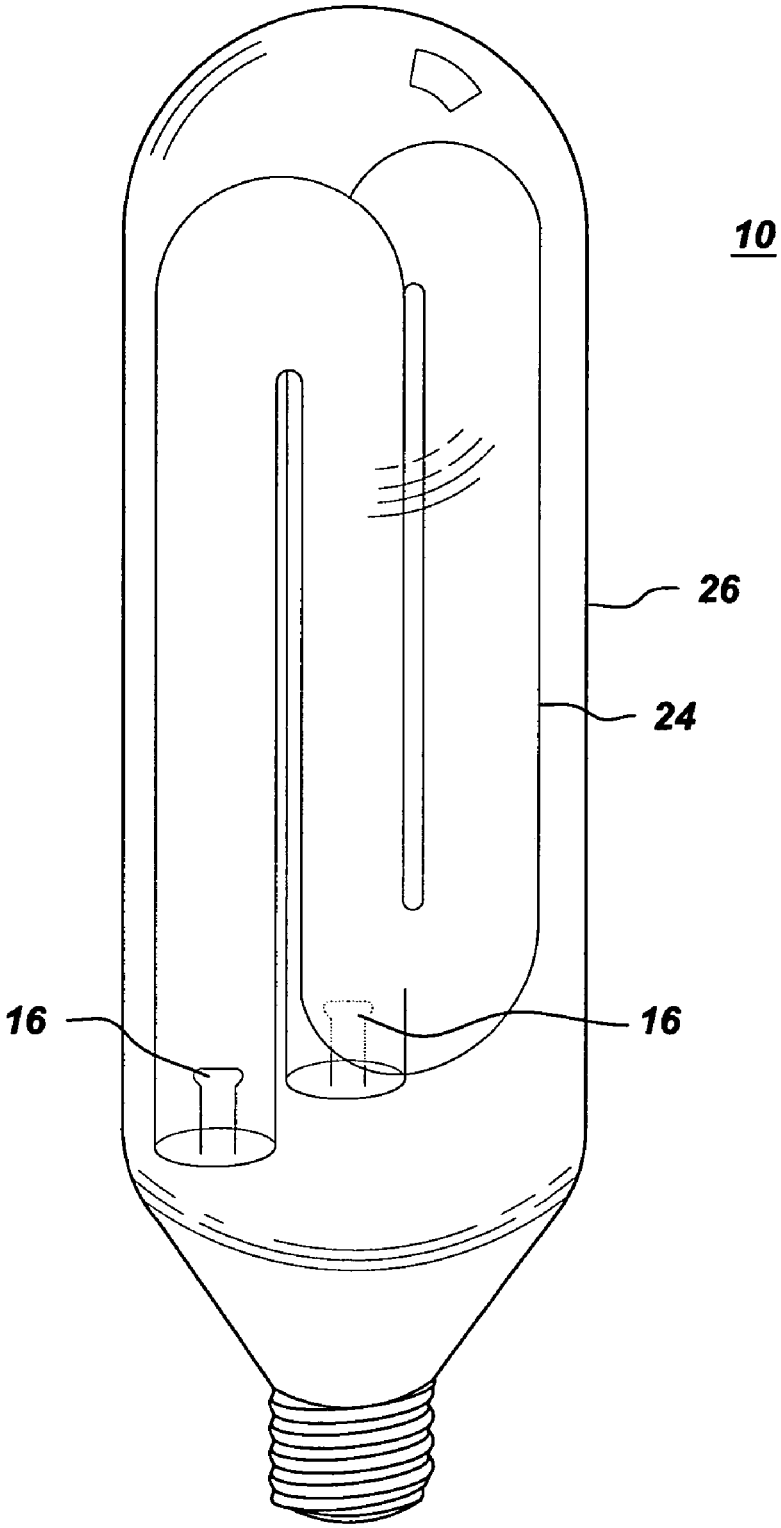
FIG. 3 is a radiation source in a third embodiment of the radiation source of the present invention.

The gas discharge radiation source housing may alternatively be embodied so as to be a multiple-bent tube or inner envelope 24 surrounded by an outer envelope or bulb 26 as shown in FIG. 3.

The housing or the envelope of the radiation source containing the ionizable composition is preferably made of a material type that is substantially transparent. The term "substantially transparent" means allowing a total transmission of at least about 50 percent, preferably at least about 75 percent, and more preferably at least about 90 percent, of the incident radiation within about 10 degrees of a perpendicular to a tangent drawn at any point on the surface of the housing or envelope.

Within the scope of this invention, phosphors may be used to absorb the radiation emitted by the discharge and emit other radiation in the visible wavelength region. In one embodiment, a phosphor or a combination of phosphors may be applied to the inside of the radiation source envelope. Alternatively, the phosphor or phosphor combination may be applied to the outside of the radiation source envelope provided that the envelope is not made of any material that absorbs a significant amount of the radiation emitted by the discharge. A suitable material for this embodiment is quartz, which absorbs little radiation in the UV spectrum range.

In one embodiment of the radiation source, wherein the housing containing the ionizable composition has an inner envelope and an outer envelope, the phosphors may be coated on the outer surface of the inner envelope and/or the inner surface of the outer envelope.

The chemical composition of the phosphor determines the spectrum of the radiation emitted. The materials that can suitably be used as phosphors absorb at least a portion of the radiation generated by the discharge and emit radiation in another suitable wavelength range. For example, the phosphors absorb radiation in the UV range and emit in the visible wavelength range, such as in the red, blue and green wavelength range, and enable a high fluorescence quantum yield to be achieved.

Figure 4:
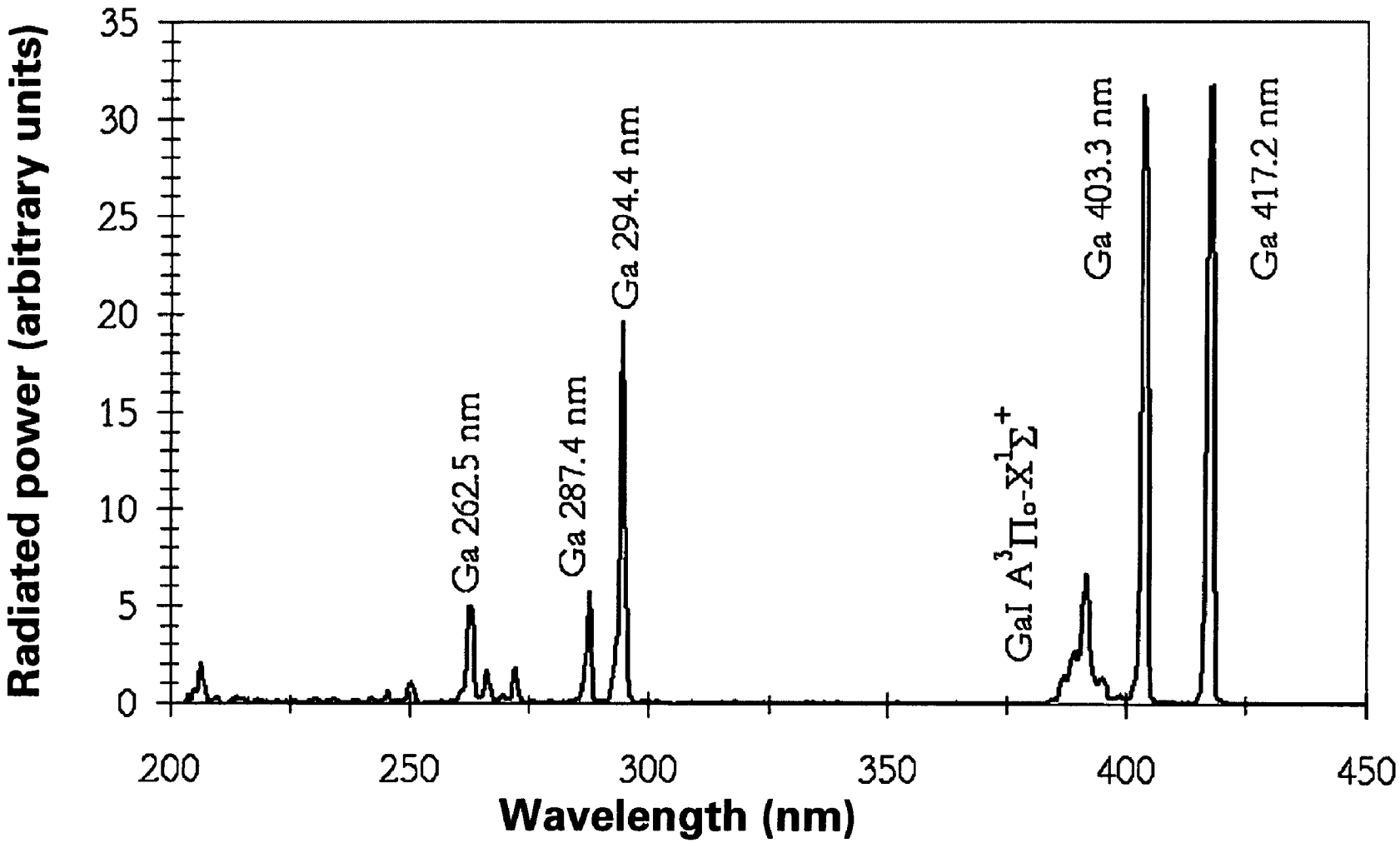
FIG. 4 is an emission spectrum of a radiation source in an embodiment of the present invention.

In a non-limiting example, for a gas discharge radiation source comprising gallium and gallium iodide, the radiation output is dominated by spectral transitions at about 294 nanometers, at about 403 nanometers and at about 417 nanometers, as shown in FIG. 4. Phosphors that convert radiation having at least one of these wavelengths, is used.

Figure 5:
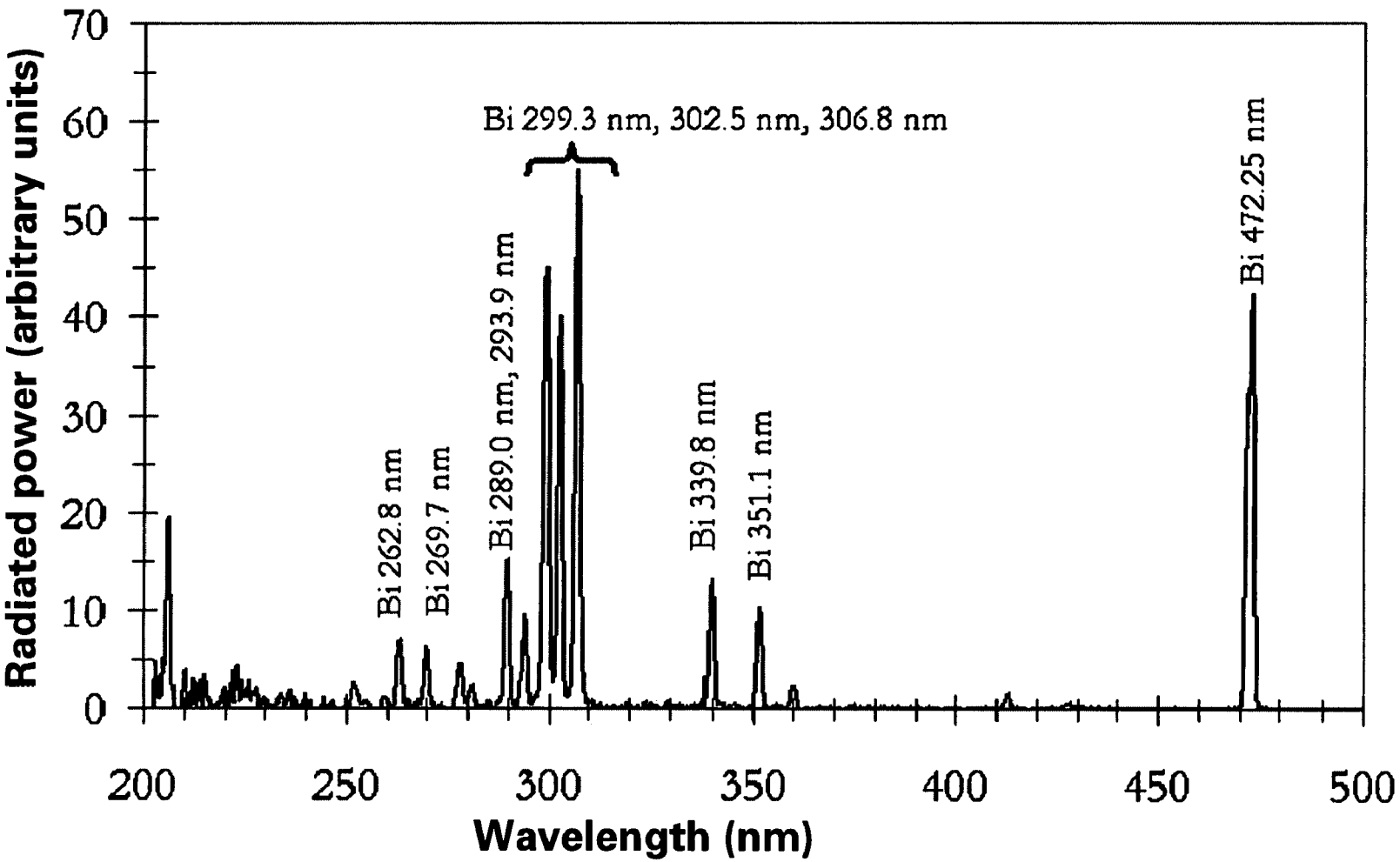
FIG. 5 is an emission spectrum of a radiation source in another embodiment of the present invention.

In a further non-limiting example, for a gas discharge radiation source comprising bismuth iodide, the radiation output is dominated by spectral transitions at about 299 nanometers, 302 nanometers, 306 nanometers, and 472 nanometers as shown in FIG. 5.

Within the scope of this invention, non-limiting examples of phosphors which may be used for the generation of light in the blue wavelength range are SECA/BECA; SPP:Eu; Sr(P,B)O:Eu; $Ba_3MgSi_2O_8$:Eu; $BaAl_8O_{13}$:Eu; $BaMg_2Al_{16}O_{27}$:Eu; $BaMg_2Al_{16}O_{27}$:Eu,Mn; $Sr_4Al_{14}O_{25}$:Eu; (Ba,Sr)$MgAl_{10}O_{17}$:Eu; $Sr_4Si_3O_8Cl_2$:Eu; $MgWO_4$; $MgGa_2O_4$:Mn; $YVO_4$:Dy; $(Sr,Mg)_3(PO_4)_2$:Cu, $(Sr,Ba)Al_2Si_2O_8$:Eu; ZnS:Ag; Ba5SiO4Cl6:Eu, and mixtures thereof.

Within the scope of this invention, non-limiting examples of phosphors which may be used for the generation of light in the green wavelength range are $Zn_2SiO_4$:Mn; $Y_2SiO_5$:Ce,Tb; $YAlO_3$:Ce,Tb; $(Y,Gd)_3(Al,Ga)_5O_{12}$:Ce; $Tb_3Al_{15}O_{12}$:Ce ZnS:Au,Cu; Al; ZnS:Cu; Al, $YBO_3$:Ce,Tb, and mixtures thereof.

Within the scope of this invention, non-limiting examples of phosphors which may be used for the generation of light in the red wavelength range are $Y(V,P)O_4$:Eu, $Y(V,P)O_4$:Dy, $Y(V,P)O_4$:In, MgFGe, $Y_2O_2S$:Eu, $(Sr,Mg,Zn)_3(PO_4)_2$:Sn, and mixtures thereof.

In one aspect of the present invention, the radiation source is provided with a means for generating and maintaining a gas discharge. In an embodiment, the means for generating and maintaining a discharge are electrodes disposed at two points of a radiation source housing or envelope and a voltage source providing a voltage to the electrodes. In one aspect of this invention, the electrodes are hermetically sealed within the housing. In another aspect, the radiation source is electrodeless. In another embodiment of an electrodeless radiation source, the means for generating and maintaining a discharge is an emitter of radio frequency present outside or inside at least one envelope containing the ionizable composition.

In still another embodiment of the present invention, the ionizable composition is capacitively excited with a high frequency field, the electrodes being provided on the outside of the gas discharge vessel. In still another embodiment of the present invention, the ionizable composition is inductively excited using a high frequency field.

Example 1

A cylindrical quartz discharge vessel, which is transparent to UV-A radiation, having a length of about 35 cm, and a diameter of about 2.5 cm, was provided. The discharge vessel was evacuated and a dose of about 0.6 mg Ga and about 8.2 mg $GaI_3$ and argon were added. The pressure of argon was about 267 Pa at ambient temperature. The vessel was inserted into a furnace and power was capacitively-coupled into the gas medium via external copper electrodes at an excitation frequency of about 13.56 MHz. Radiative emission and radiant efficiency were measured. The ultraviolet and visible output power was estimated to be about 30 percent of the input electrical power at about 110° C. When the ultraviolet radiation is converted to visible light by a suitable phosphor blend, the luminous efficacy was estimated to be about 80 lumens per Watt.

Example 2

A cylindrical quartz discharge vessel, which is transparent to UV-A radiation, having a length of about 35 cm, and a diameter of about 2.5 cm, was provided. The discharge vessel was evacuated and a dose of about 3.0 mg Ga and about 3.7 mg $GaI_3$ and argon were added. The pressure of argon was about 267 Pa at ambient temperature. The vessel was inserted into a furnace and power was capacitively-coupled into the gas medium via external copper electrodes at an excitation frequency of about 13.56 MHz. Radiative emission and radiant efficiency were measured. The ultraviolet and visible output power was estimated to be about 32 percent of the input electrical power at about 220° C. When the ultraviolet radiation is converted to visible light by a suitable phosphor-blend, the luminous efficacy was estimated to be about 80 lumens per watt.

Example 3

A cylindrical quartz discharge vessel, which is transparent to UV-A radiation, having a length of about 35 cm, and a diameter of about 2.5 cm, was provided. The discharge vessel was evacuated and a dose of about 3.7 mg Bi and about 1.2 mg $BiI_3$ and argon were added. The pressure of argon was about 267 Pa at ambient temperature. The vessel was inserted into a furnace and power was capacitively-coupled into the gas medium via external copper electrodes at an excitation frequency of about 13.56 MHz. Radiative emission and radiant efficiency were measured. The ultraviolet and visible output power was estimated to be about 25 percent of the input electrical power at about 300° C. When the ultraviolet radiation is converted to visible light by a suitable phosphor blend, the luminous efficacy was estimated to be about 55 lumens per watt.

While various embodiments are described herein, it will be appreciated from the specification that various combinations of elements, variations, equivalents, or improvements therein are foreseeable, may be made by those skilled in the art, and are still within the scope of the invention as defined in the appended claims.

What is claimed is:

1. An ionizable mercury-free and sodium-free composition consisting of an inert buffer gas, a halogen, and a metal selected from the group consisting of Ga, In, T1, Sn, Bi, Ti, Zr, and combinations thereof; wherein the composition excluding the inert buffer gas is configured to emit radiation if excited inside an arc envelope; and the composition excluding the inert buffer gas is configured to produce a total vapor pressure less than about $1\times10^3$ Pa if excited inside the arc envelope, and wherein the metal and the halogen form at least one metal halide, and at least a portion of the metal is an excess metal that is not a compound with a halide.

2. The ionizable mercury-free and sodium-free composition of claim 1, wherein the metal is selected from the group consisting of Ga, Sn, In, Bi, and combinations thereof.

3. The ionizable mercury-free and sodium-free composition of claim 1, wherein the metal is Ga.

4. The ionizable mercury-free and sodium-free composition of claim 1, wherein the composition excluding the inert buffer gas producing a total vapor pressure less than about 100 Pa if excited inside the arc envelope.

5. The ionizable mercury-free and sodium-free composition of claim 1, wherein the composition excluding the inert buffer gas producing a total vapor pressure less than about 10 Pa if excited inside the arc envelope.

6. The ionizable mercury-free and sodium-free composition of claim 1, wherein the metal and the halogen form at least one metal halide, and at least a portion of the metal is an excess metal that is not a compound with a halide.

7. The ionizable mercury-free and sodium-free composition of claim 6, wherein the at least one metal halide is a metal iodide.

8. The ionizable mercury-free and sodium-free composition of claim 6, wherein the at least one metal halide is a metal bromide.

9. The ionizable mercury-free and sodium-free composition of claim 6, wherein the excess metal consists of Ga, or Bi, or combinations thereof.

10. The ionizable mercury-free and sodium-free composition of claim 6, wherein the at least one metal halide is a gallium halide, and the excess metal is gallium.

11. The ionizable mercury-free and sodium-free composition of claim 10, wherein the gallium halide is a gallium iodide.

12. The ionizable mercury-free and sodium-free composition of claim 10, wherein the gallium halide is a gallium bromide.

13. The ionizable mercury-free and sodium-free composition of claim 6, wherein the at least one metal halide is a bismuth halide, and the excess metal is bismuth.

14. The ionizable mercury-free and sodium-free composition of claim 13, wherein the bismuth halide is a bismuth iodide.

15. The ionizable mercury-free and sodium-free composition of claim 1, wherein the composition has at least two compounds of different metals selected from the group consisting of Ga, In, Tl, Sn, Bi, Ti, Zr, and combinations thereof.

16. The ionizable mercury-free and sodium-free composition of claim 6, wherein the composition has at least two compounds of a common metal selected from the group consisting of Ga, In, Tl, Sn, Bi, Ti, Zr, and combinations thereof.

17. The ionizable mercury-free and sodium-free composition of claim 16, wherein the common metal is Ga, and the at least two compounds are different compounds of Ga.

18. A system, comprising:

an arc envelope; and an ionizable mercury-free and sodium-free composition disposed in the arc envelope, wherein the composition consists of an inert buffer gas, a metal halide, and a metal that is not a compound of a halide, wherein the metal is selected from the group consisting of Ga, Tl, Bi, Ti, Zr, and combinations thereof, wherein the composition excluding the inert buffer gas is configured to emit radiation if excited inside the arc envelope, and the composition excluding the inert buffer gas is configured to produce a total vapor pressure less than about $1\times10^3$ Pa if excited inside the arc envelope.

19. The ionizable mercury-free and sodium-free composition of claim 18, wherein the metal is selected from the group consisting of Ga and Bi.

20. The ionizable mercury-free and sodium-free composition of claim 18, comprising a phosphor coating on the arc envelope.

* * * * *

UNITED STATES PATENT AND TRADEMARK OFFICE

CERTIFICATE OF CORRECTION

PATENT NO. : 7,847,484 B2
APPLICATION NO. : 11/015636
DATED : December 7, 2010
INVENTOR(S) : Smith et al.

It is certified that error appears in the above-identified patent and that said Letters Patent is hereby corrected as shown below:

In Column 2, Line 11, delete "Ti," and insert -- Tl, --, therefor.

In Column 2, Line 14, delete "Ti," and insert -- Tl, --, therefor.

In Column 2, Line 55, delete "present" and insert -- present. --, therefor.

In Column 2, Line 62, delete "Ti," and insert -- Tl, --, therefor.

In Column 4, Line 39, delete "TI," and insert -- Tl, --, therefor.

In Column 5, Line 45, delete "TI," and insert -- Tl, --, therefor.

In Column 5, Line 55, delete "Ti," and insert -- Tl, --, therefor.

In Column 8, Line 18, delete "$GaI_3$" and insert -- $GaI_3$ --, therefor.

In Column 9, Line 7, in Claim 1, delete "T1" and insert -- Tl --, therefor.

Signed and Sealed this
Nineteenth Day of April, 2011

David J. Kappos

David J. Kappos
*Director of the United States Patent and Trademark Office*